United States Patent [19]

Godinho

[11] Patent Number: 4,744,486

[45] Date of Patent: May 17, 1988

[54] SEALING SYSTEM FOR CONTAINERS

[75] Inventor: Luis H. D. L. Godinho, Linda-a-Velha, Portugal

[73] Assignee: Seville Design Inc., Lincroft, N.J.

[21] Appl. No.: 936,813

[22] Filed: Dec. 2, 1986

[30] Foreign Application Priority Data

Dec. 2, 1985 [PT] Portugal ..... 81/592

[51] Int. Cl.[4] ..... B65D 45/32

[52] U.S. Cl. ..... 220/319

[58] Field of Search ..... 220/319, 276

[56] References Cited

U.S. PATENT DOCUMENTS 2,004,964 6/1935 Westgate et al. ..... 220/319

3,815,777 6/1974 Churan ..... 220/319

3,930,593 1/1976 Ragettli ..... 220/276

*Primary Examiner*—George T. Hall

*Attorney, Agent, or Firm*—Lerner, David, Littenberg, Krumholz & Mentlik

[57] ABSTRACT

Sealable containers are disclosed which include a plastic base with an annular rim, a plastic lid with an annular U-shaped outer periphery for application to the annular rim on the plastic base, and a U-shaped annular metallic clamping strip with a corresponding configuration to the outer periphery of the lid, so that when applied to the closed container and crimped on either side of the annular rim, the container is effectively sealed form the atmosphere.

3 Claims, 1 Drawing Sheet

SEALING SYSTEM FOR CONTAINERS

FIELD OF THE INVENTION

The present invention is directed to sealable containers. More particularly, the present invention is directed to sealable plastic containers including means for hermetically sealing the container from the atmosphere. Still more particularly, the present invention is directed to sealable plastic containers including a metalic sealing band thereon.

BACKGROUND OF THE INVENTION

There already exist a large number of closure systems for containers, including closure systems for plastic containers. The majority of these systems, however, do not guarantee the necessary tightness or degree of seal which is required for the long-term preservation of food products and the like. These systems include those which employ various types of fittings between the edge of the container wall and a groove located at the periphery of the lid. None of these previous systems thus provide the necessary tightness required by certain packaged food goods, especially that which could be sufficient to provide for the long-term preservation of food products therein.

Up till to present time it has therefore remained the case, particularly with canned food products such as canned fish, sausages, soups, jams and the like, that they have to be packed almost exclusively in metallic or glass containers employing mechanical enclosure systems. Most of these systems thus include sealing rings in order to provide the necessary air tightness to preserve these products for long periods of time, including periods of up to from two to five years. However, when employing these types of metalic or glass containers, even though they might have the necessary characteristics for such applications, these systems are clearly not a favorable solution from an economic point of view, particularly since there are other materials, such as various plastics, which are available and which are much cheaper and easier and less costly to process than are metal and glass containers. For that reason, plastic containers have recently been replacing the previous metal and/or glass containers, but it has been necessary to maintain the overall use of a metal lid in order to guarantee the tight fitting nature and seal provided by these containers along with easy opening thereof. Additional attempts have also been made to apply the same prior mechanical sealing arrangements which have been used with metallic parts to plastic components, but these have not been successful. For example, the use of friction or ultrasonic welding has been attempted, but this has been found to be impractical because it does not allow easy opening of the container, and because of the restrictions imposed by certain goods which are to be packed in these containers. For example, in the case of canned fish, it is necessary for the container to be completely filled with liquid fat or the like, and thus at the time of placement of the lid on the container overflow occurs, which prevents proper welding of the plastic surfaces thereof. A particular example of such a prior system is shown in Switzgable Jr., U.S. Pat. No. 3,204,801, which shows the use of a metal band 20 in connection with a resilient stopper 10 made of plastic, and employed in connection with a bottle or metal container 14 which is preferred by this patentee, even though mention is made of plastic cans for use therewith. In any event, the metal band 20 in this patent extends across the overall surface of the stopper 10, and has a notched lower edge 28 crimped to engage the container neck below bead 18 thereon. This closure thus relies upon radial stress created across the overall surface of the container acting against the rigid surface of the bottle or metal container 14 to create a seal. Summers, U.S. Pat. No. 4,111,331 discloses another closure which in this case includes a plastic container with an externally threaded outlet 21 extending outwardly from a circumscribing annular male boss 46. In this case, the outlet is closed with internally threaded plastic cap 24 having a flared annular skirt portion 28, and upon threaded engagement, the skirt portion is sealed to the male boss by means of a crimped metal ring 25. Additional such closures are shown in patents such as U.S. Pat. Nos. 937,847, Norton; 1,838,323, Nielsen; 2,406,568, Sebell; 2,619,246, Staller; 2,961,111, Nesme; and other such patents.

All of the above have thus constituted unsuccessful attempts to produce commercial products by which manufacturers of various products, in particular foodstuffs, have been unable to employ plastic in both components, namely the base and the lid of a container, to package such goods for preservation over long periods of time, such as two years or greater. In addition, the potential ability to use such plastic containers not only results in considerable savings, but also permits the use of different technological processes in the manufacture of these goods, such as in connection with canned fish production, where conventional methods for cooking and sterilization are still in use inspite of being time and energy consuming. On the other hand, with these plastic containers it becomes possible to use faster and more economical cooking and sterilization processes, such as microwave ovens, for example. The ability to do so could further substantially reduce production costs if possible. It is therefore an object of the present invention to overcome these prior difficulties and produce such a sealed container system.

SUMMARY OF THE INVENTION

In accordance with the present invention, these and other objects have now been accomplished by the invention of a sealable container including a plastic base member including an upstanding annular rim portion, a plastic lid member overlying said annular rim portion, the plastic lid member including an annular U-shaped outer periphery comprising inner and outer substantially parallel wall portions and a substantially planar cover portion connecting said inner wall portion so that upon application of the U-shaped outer periphery of said lid member to the annular rim portion of the base member the pair of substantially parallel wall portions are disposed on opposite sides of the annular rim portion and the cover portion is disposed substantially below the annular rim portion of the lid member, and a substantially U-shaped annular metallic clamping strip having a configuration substantially corresponding to the U-shaped outer periphery of the lid member and including inner and outer substantially parallel wall portions, whereby upon application of the clamping strip to the outer surface of the lid member and crimping of the pair of substantially parallel portions of the clamping strip towards each other, the container is effectively sealed from the surrounding atmosphere thereby.

In accordance with one embodiment of the sealable container of the present invention the outer annular rim includes an enlarged end portion.

In accordance with another embodiment of the sealable container of the present invention the outer wall portion of the clamping strip includes a depending lower portion which depends below the outer wall portion of the lid member, whereby upon crimping the clamping strip removal of the lid member from the base member is prevented. In a preferred embodiment, the clamping strip includes a weakened area in the outer wall portion, whereby the depending lower portion of the clamping strip can be removed by tearing along the weakened portion, and the lid member is then removable from the base member.

It is therefore apparent that the sealing system of the present invention employs a metallic band member or clamping strip which exerts a tight squeeze on the fitting between the base member and the lid member of the plastic base and lid, respectively. This can therefore result in the creation of an effective seal about the periphery of the container, i.e., by the use of a clamping strip or band which is made of a hard material having sufficient strength and flexibility, such as steel or aluminum. The lid itself is thus designed to include a peripheral frame which can mate with the annular rim of the container in such a way that separate gaskets or sealing rings are not required in order to obtain a proper seal. Furthermore, the pressure applied by tightening of the clamping strip around the entire periphery of the fitting results in localized sealing around that entire periphery, unlike that obtained with existing metallic belts or bands which create a pressure radially across the device. This can be seen, for example, in the Switzgable, Jr. patent discussed above. Thus, in connection with the present invention the clamping strip acts only upon the lid around the periphery of the container so as to create a seal at the location of the existing fitting between the container and the lid. On the other hand, with the previously known metallic belts or bands pressure is either applied externally to the lid, radially squeezing it against the neck of the container, or is used to simply hold the lid and the container together in order to merely maintain the relative tightness for a previous tight fitting between these components. Thus, in this case the required tightness of fit is created by the strain imposed on the plastic material itself, taking advantage of the elastic recovery of this material at the periphery of the lid and the edge of the base, by means of the pressure which is locally applied by the clamping strip itself.

It is therefore possible in accordance with this invention to guarantee an hermetic seal even in those situations where the product might overflow when the container is closed, i.e., when the lid is applied. The present system is also one which permits extreme ease of opening, since it is now sufficient to merely tear off the clamping strip to free the lid and allow its removal from the base. It is therefore also now possible for the clamping strip of this invention to be used as a tamper-proof guarantee in the case where it includes a weakened area that must be removed or torn in order to open the container. It is therefore particularly important that the lid and base members of the plastic container of the present invention include the required means for fitting these two elements together prior to application of the clamping strip hereof. That is, the lid of this container includes a peripheral frame which forms a recess or groove having an approximate U-shape for the purpose of accommodating the rim of the container body. In this manner, the upper planar portion of the lid is recessed, so that when assembled it slightly enters the inside of the container itself, thus preventing residual air from remaining between the product packed within the container and the internal surface of the lid. Furthermore, the external shape of the lid itself permits the metallic clamping ring or strip hereof to be supported both from the recessed top inner side of the lid as well as the outer side thereof, when the outer side of the metallic clamping ring is crimped or deformed inwardly into its clamping position. The edge of the container body itself therefore does not have to support radial stress imposed by the crimping of the metallic ring, but that action only compresses the sides of the groove at the periphery of the lid, and thus permits the use of a thin walled plastic container which lacks rigidity, and which could not be employed with conventional clamping rings of the type of those discussed above. Furthermore, the clamping ring itself does not need to come into contact with the container body, but can be applied exclusively to the lid itself. Sealing is thus achieved on two surfaces, i.e., on the two internal sides of the U-shaped groove formed at the periphery of the lid in contact with both the inner and outer side of the upper rim of the container body. This also substantially improves the performance of the hermetic seal produced thereby.

This invention also permits the metal clamping ring to include a lower depending edge, which may include a line of weakness, and which can be crimped below the edge of the lid to prevent the clamping ring from being displaced by its tendency to slide upwardly. Removal of the clamping ring is therefore only possible by tearing its lower edge along this line of weakness. The lower edge of the clamping ring can thus also serve as a tamper-proof device for preventing removal of the clamping ring without visably tearing same.

The overall nature and characteristics of the subject matter of the present invention will be more fully understood with reference to the following detailed description, which refers to the attached figure in which.

DETAILED DESCRIPTION

Figure 1:
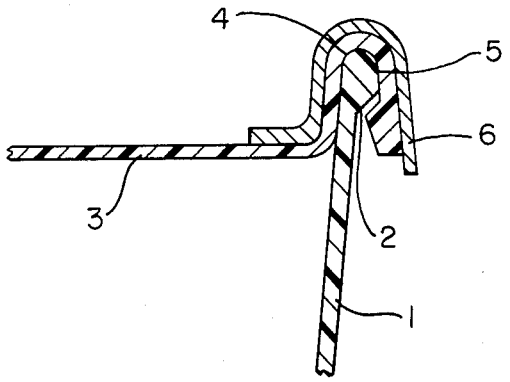
FIG. 1 is a partial, side, sectional view of one embodiment of a portion of the sealed plastic container of the present invention.
Figure 2:
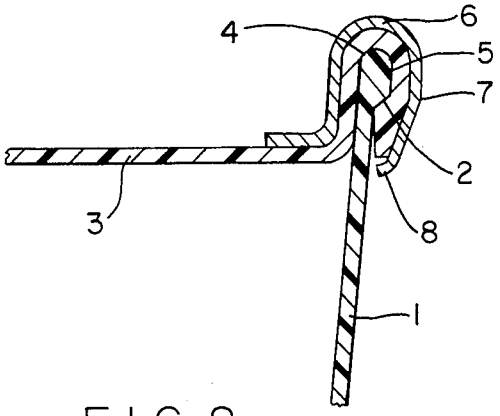
FIG. 2 is a partial, side, sectional view of another embodiment of a portion of the sealed plastic container of the present invention.

Referring to the figures, in which like numerals refer to like portions thereof, it can be seen that the plastic container of the present invention includes a container base 1 which generally has a cup-shaped configuration, one wall of which is shown in FIGS. 1 and 2. The container base 1 has at its edge a small bead 2 of suitable dimensions. On the other hand, the container lid 3, a portion of which is also shown in FIGS. 1 and 2, includes a frame or outer periphery having a generally U-shaped configuration so that it forms a recess or groove 5 which is intended to accommodate the rim 2 of the container. Thus, the interrelationship between rim 2 and groove 5 is produced with dimensions so as to create a small pressure therebetween and can in itself provide a relatively tight seal, which is already used in several applications. However, this is not an absolutely tight system, which is an indispensable requirement for long-term preservation of canned foodstuffs and the like. In order to therefore guarantee necessary tightness, in accordance with the present invention a system is employed which also uses a clamping strip 6. Clamping strip 6 is thus mechanically clamped so that it tightly squeezes the frame 4, in this way improving the seal between the rim 2 at the edge of base 1 and groove 5 at the periphery of lid 3.

As can be seen from FIGS. 1 and 2, clamping strip 6, having a suitable thickness, has a contour which is adapted to this specific configuration for the particular rim 2 and groove 5 in base 1 and lid 3 of the container, which provides preliminary sealing between the base and lid. Therefore, clamping strip 6 can have various configurations, but preferably has the generally U-shaped configuration shown in the figures.

In application, the clamping strip 6 is applied and crimped all the way around the sealing area, and it can eventually overlap to some extent in certain places over this sealing area. In this manner, a pressure is exerted at every point of the fitting comprising the plastic material of the container, which in turn provides for the tightness of the seal created thereby. Sealing is thus not achieved through a radial squeeze on the container body, but simply by clamping of the sides of the U-shaped metallic strips 6 together.

To remove clamping strip 6, and to therefore allow opening of a container, various systems can be utilized. For example, clamping strip 6 can have a rim or flap 8 which can be removed in order to remove the clamping strip 6 from the lip 3. This flap 8, which can be distinct from the clamping ring 6 itself by means of a weakened line 7, has a lower edge that can sit partially under the edge of lid 3. This will prevent the metal clamping strip 6 from being displaced by its tendency to move upwardly. Thus, it is only by tearing off the lower edge 8 of the clamping strip 6, by means of tearing weakened line 7, that the remaining effect of the flap 8 be broken, allowing the clamping strip 6 to be removed.

The clamping strip 6 can be made from any metallic material as long as it possesses adequate characteristics for this application, such as the required flexibility, but it also must be rigid enough to maintain its grip on the frame of the lid. In this manner, the sealing system of the present invention provides near perfect tightness, thus allowing the use of containers in which both the lid and the base are made from plastic material. This represents a significant step forward in this industry, primarily due to significant savings in packaging and in achieving the possibility of using other methods to process foodstuffs and the like packed therein. In particular, these plastic containers permit the use of microwave ovens for cooking and sterilizing the food in a fraction of the time as is the case with more conventional methods.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A sealable container comprising a plastic base member including an upstanding annular rim portion, a plastic lid member overlying said annular rim portion, said plastic lid member including an annular U-shaped outer periphery comprising inner and outer substantially parallel wall portions and a substantially planar cover portion connecting said inner wall portion so that upon application of said U-shaped outer periphery of said lid member to said annular rim portion of said base member, said pair of substantially parallel wall portions are disposed on opposite sides of said annular rim portion and said cover portion is disposed substantially below said annular rim portion of said lid member, and a substantially U-shaped annular metallic clamping strip having a configuration substantially corresponding to said U-shaped outer periphery of said lid member and including inner and outer substantially parallel wall portions, said clamping strip being formed from a predetermined length of said metal so as to provide for overlap at the ends of said clamping strip, said outer wall portion of said clamping strip including a depending lower portion depending below said outer wall portion of said lid member, whereby upon application of said clamping strip to the outer surface of said lid member and crimping of said pair of substantially parallel wall portions of said clamping strip towards each other, said container is effectively sealed from the surrounding atmosphere thereby, while at the same time facilitating removal of said clamping strip.

2. The sealable container of claim 1 wherein said annular rim portion includes an enlarged end portion.

3. The sealable container of claim 1, wherein said clamping strip includes a weakened area in said outer wall portion thereof, whereby said depending lower portion of said clamping strip can be removed by tearing along said weakened portion, and said lid member is then removed from said base member.

* * * * *

UNITED STATES PATENT AND TRADEMARK OFFICE

CERTIFICATE OF CORRECTION

PATENT NO. : 4,744,486

DATED : May 17, 1988

INVENTOR(S) : Luis H. D. L. Godinho

It is certified that error appears in the above-identified patent and that said Letters Patent is hereby corrected as shown below:

Column 6, line 50, "removed" should read --removable--.

Signed and Sealed this

Twentieth Day of September, 1988

*Attest:*

DONALD J. QUIGG

*Attesting Officer*

*Commissioner of Patents and Trademarks*